United States Patent [19]

Nilsson

[11] Patent Number: 4,842,493

[45] Date of Patent: Jun. 27, 1989

[54] PIEZOELECTRIC PUMP

[75] Inventor: Kenth Nilsson, Akersberga, Sweden

[73] Assignee: Qenico AB, Sweden

[21] Appl. No.: 121,347

[22] Filed: Nov. 16, 1987

[30] Foreign Application Priority Data

Nov. 14, 1986 [DE] Fed. Rep. of Germany ..... 3638883

[51] Int. Cl.[4] ..... F04B 17/00

[52] U.S. Cl. ..... 417/322; 417/410; 346/140 R; 310/328

[58] Field of Search ..... 417/322, 410, 412; 346/75, 140 RX, 140 PD; 400/126; 310/328 X

[56] References Cited

U.S. PATENT DOCUMENTS

| | | | |
|---|---|---|---|
| 3,390,559 | 7/1968 | Steutzer | 310/328 |
| 4,364,067 | 12/1982 | Koto et al. | 356/140 R |
| 4,533,219 | 8/1985 | Aldrich | 310/328 |
| 4,536,097 | 8/1985 | Nilsson | 400/126 |
| 4,566,017 | 1/1986 | Nilsson | 346/140 R |
| 4,668,964 | 5/1987 | Padalino et al. | 346/75 |

FOREIGN PATENT DOCUMENTS

| | | | |
|---|---|---|---|
| 0021755 | 7/1981 | European Pat. Off. . | |
| 2047628 | 12/1980 | United Kingdom . | |
| 2050949 | 1/1981 | United Kingdom . | |
| 2098134 | 11/1982 | United Kingdom . | |
| 2134041 | 8/1984 | United Kingdom | 346/75 |

OTHER PUBLICATIONS

Edmiston, "Piezoceramic Transducers", *Electronic Design* 18, Sept. 1, 1974, pp. 78–82.

Reynolds III et al., "Consider Piezoelectric Ceramics", *Electronic Design* 19, Sept. 13, 1977, pp. 92–97.

"Recording Head", by Hiroshi Kiyougora—vol. 3, No. 150, (E-158), Dec. 11, 1979.

*Primary Examiner*—Donald E. Stout

[57] ABSTRACT

In order to significantly intensify the pump action in a piezoelectric pump without long-term, negative consequences, and in order to be able to employ a great variety of fluids, the pump of the invention is formed of piezoceramic parts arranged essentially parallel to and at a distance from one another. They are provided with electrical contacts at both sides, and are covered at both sides with closure means. The cavity between the piezoceramic parts and the closure means forms the pump channel. The electrical contacts lie essentially perpendicular relative to the closure means. The polarization direction in the piezoceramic parts lies parallel to the electrical field strength. A multi-channel pump, particularly for an ink-jet matrix printer means, can be manufactured in an especially simple way by use of known semiconductor manufacturing techniques.

13 Claims, 6 Drawing Sheets

PIEZOELECTRIC PUMP

BACKGROUND OF THE INVENTION

The invention is directed to a piezoelectric pump, particularly for ink-jet matrix printer devices, wherein a pump channel is formed by first and second piezoceramic parts arranged parallel to and at a distance from one another and wherein each piezoceramic part is provided with electrical contacts at both sides. The piezoceramic parts are polarized such that a polarization direction lies parallel to a field strength generated by applying a voltage to the contacts. A space between the piezoceramic parts is covered with a closure means. U.S. Pat. No. 4,536,097 incorporated by reference herein discloses such a multi-channel pump which is used as a piezoelectrically operated write head for an ink-jet matrix printer device. Ink channels which can directly represent the write nozzles for the ink-jet matrix printer means are formed by piezoceramic parts arranged parallel and side-by-side, and which are covered at both sides. The piezoceramic parts are electrically contacted at both sides. In this arrangement, the piezoceramic parts which limit the ink channels directly form the drive elements, and writing fluid can be ejected drop-by-drop based on the piezoelectric deformation. The electrical contacts thus lie essentially parallel to the coverings, of which at least one is directly formed of metal and can serve as a common electrode.

In this known channel matrix, two dimensions (the transverse dimensions) of the piezoceramic parts collaborate given application of an electrical voltage in order to produce a volume change in the ink channel. The third dimension (the longitudinal dimension), however, acts opposite relative to the two other dimensions. Stated in rough terms, a net volume change of $+2-1=+1$ thus derives as a result.

Also occurring—at least in some of the exemplary embodiments disclosed by the aforementioned patent—is that the writing fluid is in direct electrical contact with the contactings, so that the fluid must exhibit good electrical insulating properties and high electrical puncture strengths (on an order of magnitude of $=1$ kV/mm). The selection of usable fluids is thus greatly limited. All water-containing writing fluids are unusable in such a system.

SUMMARY OF THE INVENTION

An object of the present invention is to specify a piezoelectric pump wherein the pump action is significantly increased in a simple fashion and can be retained unmodified over a long time span. Furthermore, a large number of different writing fluids should be employable.

This object is achieved by a piezoelectric pump wherein the piezoceramic parts are parallel to one another, are covered with a closure means, and wherein the electrical contacts on the piezoceramic parts at both sides thereof are arranged substantially perpendicular to the closure means. In the pump of the invention, the electrical contacts to the piezoceramic parts lie perpendicular relative to the closure means, which can be advantageously formed of a plate. When a voltage is applied to a piezoceramic part, for example, a cuboid piezoceramic part contacted in this fashion, the length and height thereof decrease and the width thereof increases. The pump channel limited by two such piezoceramic parts thus becomes lower, narrower, and shorter. All three dimensions of the piezoceramic parts therefore collaborate in a diminution of the enclosed pump volume. Again stated in rough terms, the pump thus has the efficiency $+3$ in comparison to the known pump having the efficiency $+1$.

It is provided in a development of the invention that the contacts lying in the pump channel comprise identical polarity. No voltage thus lies across the fluid to be pumped, so that fluids having poor insulating properties or conductive fluids can also be employed.

The pump has a number of significant advantages. As a result of the extremely small structures, the opening of the pump channel can itself serve as a nozzle. Furthermore, this structure achieves an especially good force transmission from the piezoceramic parts onto the fluid to be pumped and, even though work is carried out with a relatively low excitation voltage of, for example, 130V, a high safety margin results, i.e. the volume change produced is greater than the droplet volume. The size of the droplets can be simply modulated by changing the amplitude or the time of the applied voltage pulses. Furthermore, air that may possibly be enclosed is quickly and reliably eliminated from the pump channel given this design.

All of these advantages make it possible to utilize the pump of the invention for the greatest variety of applications. For example, a multi-channel pump of this type can be utilized as a write head in an ink-jet matrix printer means for recording alphanumeric characters or images. Furthermore, the pump can be employed as a micro-metering equipment (micro pipette) in chemical analyses. Furthermore, the pump can be used for fluid metering in high resolution fluid chromatographs, or can also be used in hallothane vaporizers in anesthesia.

It is provided in a development of the invention that the polarization direction in the piezoceramic parts exhibits the same direction as the electrical field strength. It is thus assured that the voltage pulses needed for the excitation do not produce any depolarization in the piezoceramic. The pump of the invention has the great advantage that the polarization of the piezoceramic material need not be undertaken until the pump is completely manufactured, this being capable of being achieved with a voltage pulse with the same type as for the later excitation, possibly merely with a higher voltage amplitude. A further advantage of the pump of the invention is that the channel volume is diminished in the excitation by applying a voltage pulse. In a quiescent condition, i.e. when the piezoceramic is shorted, the pump exhibits a greater channel volume. A droplet is ejected only when the electrical voltage is applied in the polarization direction. The ceramic is therefore mechanically stressed only during the respective, short voltage pulses needed for the excitation, so that a high useful life results. Since the pump is in its quiescent condition in the voltage-free state, a system comprising the pump of the invention can be simply shut off without having to undertake precautions that must prevent an ejection of a droplet during the shut-off event. A possible creep of the material is reliably avoided as a result of the short voltage pulses.

In a development of the invention, the pump channel is closed at its back end and a groove running transversely relative to the pump channel connects this channel to a fluid reservoir. The resulting pump action is further intensified in the direction of the discharge opening.

The pump of the invention can be advantageously manufactured since a channel lying essentially parallel to two cuboid faces is first worked out of an approximately cuboid piezoceramic part. Subsequently, the surface of this channel and at least parts of the cuboid surface are provided with separate electrical contacts, this being potentially carried out, for example, by metallizing the surface. The channel can be closed, for example, with a cover, so that the desired pump channel results.

An especially advantageous manufacturing method results for the manufacture of a multi-channel, piezoelectric pump. Known semiconductor processing techniques can thus be used. The method provides that channels are worked out of a piezoceramic wafer proceeding from both sides, for example, by sawing, and that these channels lie offset relative to one another and at least partially overlap. The wafer processed in this way is subsequently metallized. After this, the metallization is eliminated at one side at the floor of the channels. The channels are covered with closure means at the other side.

It is just as possible to first cut the wafer processed in this way into cuboids whose size corresponds to the desired multi-channel pumps and to subsequently provide these cuboids with closure means. A plurality of multi-channel pumps can be manufactured in practically one work sequence in this manufacturing method, whereby the costs can be considerably reduced.

There is practically no mechanical over-coupling or only a negligibly low mechanical over-coupling from one pump channel to the other in a structure produced in this way. Furthermore, only moderate tolerances are required for the manufacture.

Since a certain quantity of piezomaterial is needed for generating the necessary energy that is to be transmitted onto the fluid to be pumped, the number of possible pump channels per mm in a row is thus already limited. In order to increase the resolution, it is provided in an advantageous development of the invention that every pump channel is in communication with a channel lying at an acute angle thereto. Two channels intersect in an opening at the height of the discharge opening of the pump channels and between these channels. The normal discharge openings of the pump channels are closed. Dependent on what energy is supplied to the two pump channels associated with an opening, and dependent on the time at which this energy is supplied, practically the entire region established by the angle between the two channels can be covered. It is thus provided in accordance with the invention that the individual pump channels are activated such that the direction of the fluid droplets departing the opening can be varied. When, for example, only one ink channel is activated, then the fluid droplet departs the opening in the direction of the channel in communication with this ink channel. When both ink channels are activated simultaneously and with equal strength, then a droplet results which is ejected practically in the direction of the median line between the two channels, i.e. parallel to the direction of the ink channels.

In a further development of the invention, the excitation voltage applied to the contacts has an AC voltage superimposed on it. This AC voltage practically generates an ultrasound in the pump channels. This has the advantage that the ink cannot stick to the walls of the pump channels. The possibility of also using fluids containing, for example, pigments, thus results.

DESCRIPTION OF THE PREFERRED EMBODIMENTS

Figure 1:
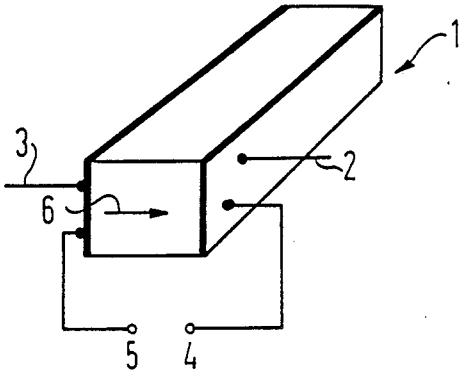
FIG 1 (PRIOR ART)
FIGS. 1 and 2 illustrate the conditions in a piezoceramic cuboid, first without, and then with, applied voltage.

In FIG. 1 reference numeral 1 indicates a cuboid of piezoceramic whose lateral faces are provided with electrical contacts 2 or 3. An electrical voltage can be applied to this cuboid 1 via terminals 4 or 5. The polarization direction in the cuboid is indicated with the arrow 6. This lies parallel to the electrical field generated by the applied voltage. It should preferably be isodirectional with the field strength in order to avoid depolarizations.

Figure 2:
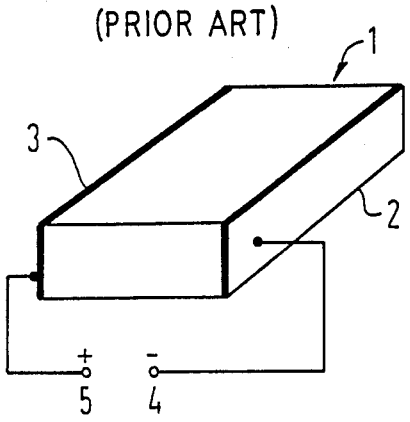
FIG 2 (PRIOR ART)

An electrical voltage is applied to the cuboid 1 in FIG. 2. This results in the cuboid being broader, flatter, and shorter.

Figure 3:
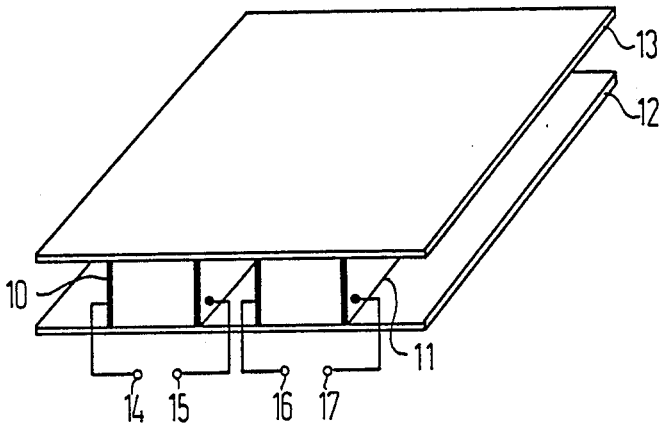
FIGS. 3 and 4 show a first embodiment of the pump of the invention in a schematic view, first without, and then with, applied voltage.
Figure 4:
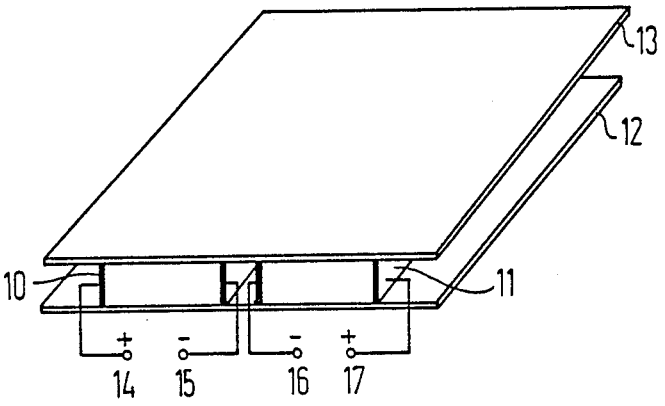

FIGS. 3 and 4 show a first exemplary embodiment of a pump of the invention. Identical parts are provided with the same reference characters. Two piezoelectric cuboids 10 and 11 are arranged parallel side-by-side and are covered at the upper and lower underside with a plate 12 and 13. An electrical voltage can be applied to the two cuboids via the terminals 14, 15 or 16, 17. This condition is shown in FIG. 4. As one can see from this FIG., the application of the voltage results in the pump channel being formed in a space between the two cuboids 10 and 11 and the cover plates 12 and 13 becoming narrower, flatter, and shorter, so that the enclosed volume or space is greatly diminished. Without applied voltage, the pump is in its quiescent condition and can be filled with fluid. Upon application of a voltage, preferably of a voltage pulse, this volume is suddenly constricted in all directions. The energy thus transmitted onto the fluid leads to the fact that fluid—if no further measures are undertaken—is ejected from both ends of the pump channel. When one wishes to intensify the effect at the front side, then it is possible, for example, to close the back opening of the pump channel. What is achieved by this direct action of the piezoelectric cuboid on the fluid up to the discharge opening is that fluid droplets having a well-definable size can be ejected with relatively low voltage amplitudes. The droplet size can be easily and reliably influenced by varying the voltage amplitude or the pulse width.

Even this simple embodiment represents a considerable improvement over known pumps. It is possible within the framework of the invention to arrange a plurality of such piezoceramic cuboids side-by-side and to cover them with common plates. What is important is that the electrical contacts are arranged perpendicular to the cover plates in accordance with the invention.

Further significant advantages result given an exemplary embodiment as shown in FIGS. 5 through 8.

Figure 5:
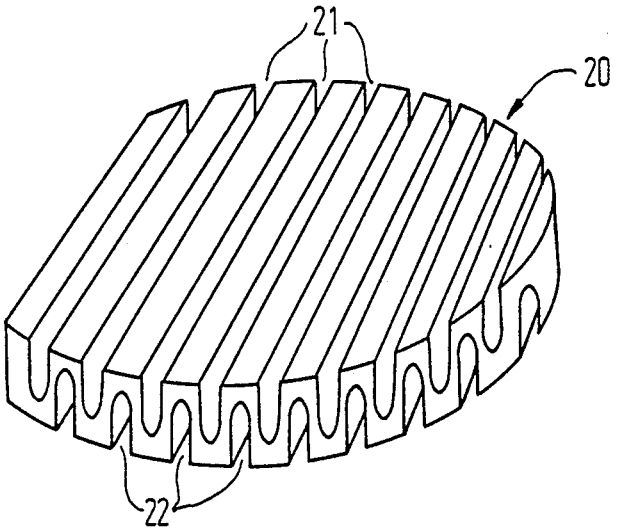
FIG. 5 illustrates a first manufacturing step for a multi-channel pump.

FIG. 5 shows a piezoceramic wafer or piece 20 into which channels or grooves 21 or 22 have been sawed from the upperside and underside. The grooves lie offset relative to one another and partially overlap. This can be seen more clearly from FIG. 6 in which a piezoceramic wafer 20 is shown in section.

Figure 6:
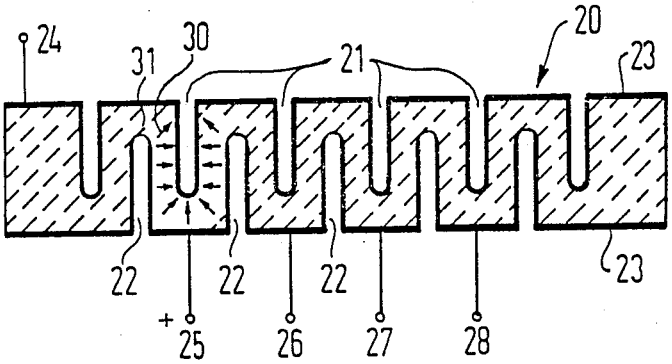
FIGS. 6 through 8 show further manufacturing steps for the multi-channel pump.

As likewise shown in FIG. 6, the piezowafer 20 is metallized over its entire surface in a further step. The metal layer is referenced 23. Subsequently, the metal layer is removed in the channels 22 at the floor thereof, proceeding from the underside in this exemplary embodiment. This can again be carried out by sawing with a thinner diamond saw blade. Electrical terminals 24–28 are also shown in FIG. 6. The terminal 24 thus serves as a common terminal for all channels. When, for example, an electrical voltage is applied between the terminal 24 and the terminal 25, then an electrical field strength indicated by the arrows 30 acts on the structure. What is advantageous in this exemplary embodiment is that the piezoceramic need not be already polarized in an earlier manufacturing stage. This can be carried out after the multi-channel piezoelectric pump has been completely manufactured, and is carried out in that a preferably higher voltage pulse is applied to the terminals. It is thus automatically achieved that the polarization in the piezoceramic lies parallel and isodirectional relative to the electrical field strength which occurs given a later applied excitation pulse. As can be further derived from FIG. 6, the pump channel is not only practically diminished in inwardly directed form only from the side given application of a voltage pulse, but is also diminished in its floor region, so that a volume change is further increased. Moreover, a far smaller movement of the piezoceramic material is produced in the upper region of the pump channel, so that only a slight mechanical stress is transmitted onto the cover (not shown here). Since the cover in this exemplary embodiment advantageously does not have any carrying function, it can also be designed so thin that it can elastically follow this slight movement.

Although the piezoceramic in the illustrated exemplary embodiment is highly mechanically deformed in the region of the electrode 25 to which a voltage is applied, this deformation is not transmitted onto a neighboring peizoceramic region hardly at all since the two regions are connected to one another only by a narrow bridge 31. A crosstalk is thus largely suppressed.

Figure 7:
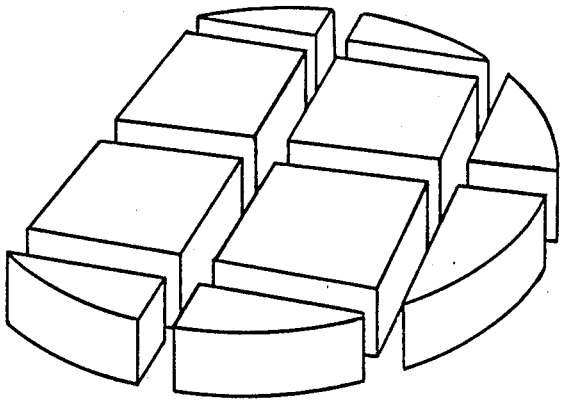

The following FIG. 7 schematically shows how a finished piezoceramic wafer comprising channels and electrical contacts can be cut into arbitrary cuboids or rectangular blocks which correspond to the size of the desired multi-channel pump.

Figure 8:
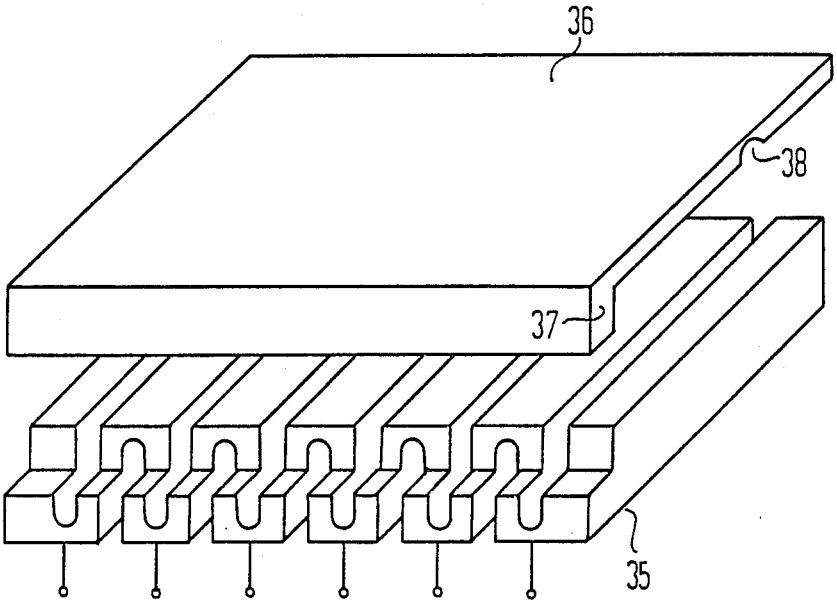

Finally, FIG. 8 shows such a cuboid or block 35 in an enlarged view. A part of the piezoceramic is ground off in the region of the front discharge openings of the channels. A cover plate 36 comprises a corresponding projection 37. The plate, for example, can be composed of metal and can directly serve as a common electrode for all pump channels. When this plate is put in place on the piezoceramic cuboid or block, the ink channels are partially covered in height, so that a smaller discharge opening results.

The cover 36 also has a channel 38 which proceeds transversely relative to the pump channels and via which all channels can be connected to a fluid reservoir. The backside of the pump channels can again be entirely or partially closed (not shown here).

Figure 9:
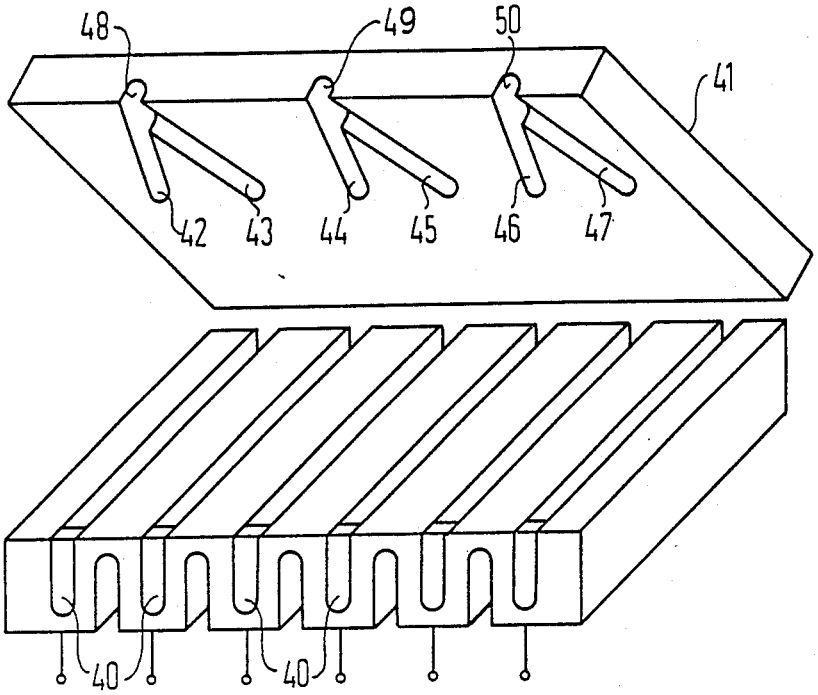
FIG. 9 illustrates a further exemplary embodiment of a multi-channel pump having increased resolution.

FIG. 9 shows another exemplary embodiment of a multi-channel, piezoelectric pump wherein a cuboid or block comprising a plurality of pump channels again forms the basic structure. The front openings of these channels are closed by inserts 40. In this exemplary embodiment, the cover 41 comprises channels 42–47 which proceed at an acute angle relative to the pump channels and whereby every channel is in communication with the pump channel in terms of fluid. The channels 42, 43; 44, 45 and 46, 47 discharge into nozzles 48, 49 or 50 in the cover 41.

Figure 10:
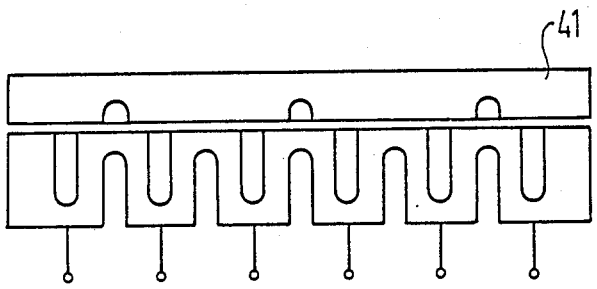
FIG. 10 is a front view of this pump according to FIG. 9.
Figure 11:
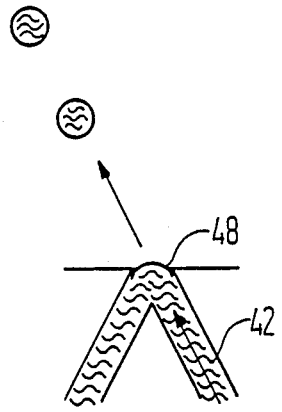
FIGS. 11 through 14 show possible jet directions for the ejected fluid droplets.
Figure 12:
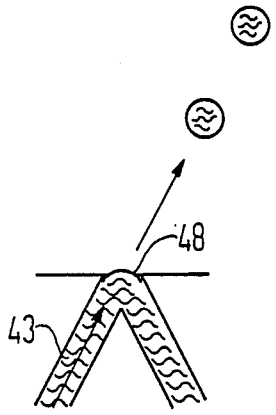
Figure 13:
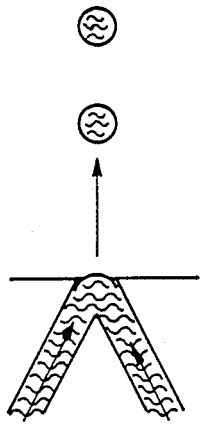
Figure 14:
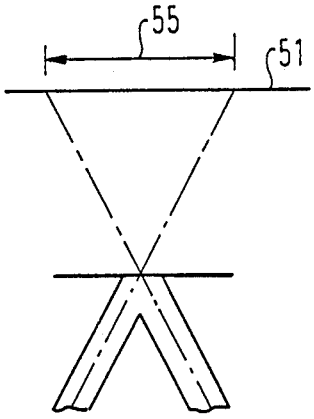

FIG. 10 again shows this pump in a front view, this time with the cover 41 put in place. The resolution can be significantly enhanced with the assistance of such a pump, this being of considerable significance particularly given employment for an ink-jet matrix printer means. As already stated at the outset, the number of pump channels per mm cannot be arbitrarily increased. The limit lies at about 4 pump channels per mm. As schematically indicated in FIGS. 11–14, the direction of the ejected fluid droplets can be changed with the assistance of the multi-channel pump according to the exemplary embodiment as shown in FIGS. 9 and 10. For this purpose, it is assumed in FIG. 11 that only the pump channel in communication with the channel 42 is activated. In this case, the liquid droplets depart the nozzle 48 in the direction of the channel 42. In FIG. 12, only the pump channel in communication with the channel 43 is activated, whereby the fluid droplets depart the nozzle 48 in the direction of the channel 43. It is assumed in FIG. 13 that both pump channels are activated simultaneously and with equal strength. Deriving as a superimposed effect is that the fluid droplets depart the pump perpendicularly. FIG. 14 again shows these conditions, whereby, for example, a recording plane 51, for example the plane of the recording paper, is indicated at a distance therefrom. The arrow 55 indicates the entire, possible recording area which can be swept if only the two pump channels are activated with different intensities and at different times, or with different pulse lengths.

Particularly for an ink-jet matrix printer means, the possibility again results of having the option to work with lower resolution at a higher printing speed, or with extremely high resolution and a somewhat reduced printing speed.

Although the invention has been described with respect to preferred embodiments, it is not to be so limited as changes and modifications can be made which are within the full intended scope of the invention as defined by the appended claims.

I claim as my invention:

1. A piezoelectric pump, comprising:

a pump channel formed by first and second piezoceramic parts arranged substantially parallel to and at a distance from one another and wherein each is provided with electrical contacts at both sides;

said piezoceramic parts being polarized such that a polarization direction lies parallel to a field strength generated with voltage applied to the electrical contacts;

a space between the first and second piezoceramic parts being enclosed with closure means for closing opposite sides of the space so as to form the pump channel; and the electrical contacts being arranged substantially perpendicular to the closure means.

2. A pump according to claim 1 wherein said closure means comprises first and second spaced apart plates having the first and second piezoceramic parts therebetween.

3. A pump according to claim 1 wherein said closure means comprises a plate covering one side of the channel and an opposite side of the channel being closed with piezoceramic material integral with the first and second piezoceramic parts.

4. A pump according to claim 1 wherein the polarization direction in the piezoceramic parts has a same direction as the field strength.

5. A pump according to claim 1 wherein a cover is provided at one of said opposite sides, and the pump channel being closed at a back end thereof opposite an ink ejection end and being connected to a fluid reservoir via a groove in the cover proceeding substantially transversely relative to the channel.

6. A pump according to claim 1 wherein electrical terminals to the contacts lie outside of a fluid system of the pump.

7. A pump according to claim 1 wherein a plurality of said first and second piezoceramic parts are formed by a piezoceramic block having parallel opposite first and second faces, parallel channels being provided in the first and second faces extending inwardly such that the channels of the first face lie offset relative to and partially overlap with the channels of the second face; metallization being provided in channels at the first and second faces but the metallization in the channels of the second face not covering a floor of the channels so as to provide an insulating gap thereat; and the channels of the first face forming a plurality of said pump channels.

8. A pump according to claim 7 wherein the closure means comprises a cover plate on the first face and a floor of the channels of the first face.

9. A pump according to claim 8 wherein the cover plate has therein an acute angle channel associated and in communication with each of said pump channels and wherein adjacent pairs of acute angle channels intersect at a discharge opening in the cover plate between pump channels, and wherein means are provided for closing off an end of the pump channels adjacent the discharge openings.

10. A pump according to claim 9 wherein electrical potential means are connected to adjacent pairs of pump channels associated with each discharge opening for varying a direction of fluid droplets ejected from the discharge opening depending upon electrical potentials supplied by the potential means to each channel pair associated with the discharge opening.

11. A pump according to claim 1 wherein an excitation voltage applied to the contacts comprises an excitation voltage with an AC voltage superimposed on it.

12. A piezoelectric pump, comprising:

a pump channel formed by first and second piezoceramic parts arranged substantially parallel to and at a distance from one another and wherein each is provided with electrical contacts at both sides;

said piezoceramic parts being polarized such that a polarization direction lies parallel to a field strength generated with voltage applied to the electrical contacts;

a space between the first and second piezoceramic parts being enclosed with closure means for closing opposite sides of the space so as to form the pump channel;

the electrical contacts being arranged substantially perpendicular to the closure means; and the electrical contacts lying in the pump channel having identical polarity.

13. A piezoelectric ink-jet matrix printer pump, comprising;

a block having first and second opposite major faces;

a plurality of parallel first channels extending inwardly from the first face and a plurality of second channels extending inwardly from the second face;

the first channels being interleaved with the second channels and overlapping therewith;

a metallization layer within the first and second channels;

an electrical connection between the metallization layer in all of the first channels so they are commonly connected;

the metallization layer within the second channels being removed at a floor portion thereof;

an electrical connection connecting adjacent metal layers in adjacent pairs of the second channels; and means for covering an open side of the first channels of the first face such that pump channels are formed by the first channels.

* * * * *